US008056777B2

(12) United States Patent
Schulman

(10) Patent No.: US 8,056,777 B2
(45) Date of Patent: Nov. 15, 2011

(54) COMPOSITE HANGER

(75) Inventor: Jared D. Schulman, Sandy Hook, CT (US)

(73) Assignee: Hanger Network, Inc., New York, NY (US)

( * ) Notice: Subject to any disclaimer, the term of this patent is extended or adjusted under 35 U.S.C. 154(b) by 195 days.

(21) Appl. No.: 12/010,732

(22) Filed: Jan. 29, 2008

(65) Prior Publication Data

US 2009/0188953 A1 Jul. 30, 2009

(51) Int. Cl.
*A41D 27/22* (2006.01)

(52) U.S. Cl. ..... 223/87

(58) Field of Classification Search ..... 223/85, 223/87, 91, 96, 95; 206/278, 292
See application file for complete search history.

(56) References Cited

U.S. PATENT DOCUMENTS

| | | | | | |
|---|---|---|---|---|---|
| 1,510,915 | A | | 10/1924 | Bartnholdi | |
| 1,580,839 | A | * | 4/1926 | McKenna | 223/85 |
| 1,619,742 | A | * | 3/1927 | Mayhew | 223/87 |
| 1,662,819 | A | | 3/1928 | Cave | |
| 1,760,352 | A | | 5/1930 | Feigelman | |
| 2,057,045 | A | * | 10/1936 | Moore | 223/87 |
| 2,306,254 | A | | 12/1942 | Quackenbush | |
| 2,328,142 | A | | 8/1943 | Hanauer | |
| 2,386,603 | A | | 10/1945 | Glaser | |
| 2,617,565 | A | | 11/1952 | Suydam | |
| 3,001,675 | A | * | 9/1961 | Aynes et al. | 223/87 |
| 3,049,272 | A | * | 8/1962 | Tufts | 223/88 |
| 3,162,341 | A | * | 12/1964 | Strampe | 223/87 |
| RE25,841 | E | | 8/1965 | Gingher | |
| 3,246,812 | A | | 4/1966 | Walker et al. | |
| 3,289,901 | A | * | 12/1966 | Zwanzig | 223/88 |
| 3,792,804 | A | | 2/1974 | Ponzo | |
| 4,132,309 | A | | 1/1979 | Shaylor | |
| 4,940,174 | A | | 7/1990 | Parker | |
| 5,027,945 | A | | 7/1991 | Wilkins | |
| 5,058,740 | A | | 10/1991 | Coursen | |
| 5,501,378 | A | | 3/1996 | Kolton et al. | |
| 5,718,362 | A | | 2/1998 | Silverman | |
| 5,857,597 | A | | 1/1999 | Kolton | |

(Continued)

FOREIGN PATENT DOCUMENTS

DE 93 09 748.4 11/1993

(Continued)

OTHER PUBLICATIONS

U.S. Appl. No. 10/312,825, filed Sep. 8, 2003, James G. Smith.

(Continued)

*Primary Examiner* — Gary L Welch
*Assistant Examiner* — Nathan Durham
(74) *Attorney, Agent, or Firm* — Lowenstein Sandler PC

(57) ABSTRACT

Disclosed is an apparatus for hanging articles and the method of manufacturing the apparatus includes a hanger body having first and second paperboard panels separated from one another by a fold line. The first paperboard panel includes a central tab extending from a periphery thereof opposite the fold line. A polymeric hook portion engages with the hanger body and includes a support portion and a hook base, the hook base having an alignment aperture formed therein through which the central tab of the first paperboard panel is inserted so as to provide means for securing the polymeric hook to the hanger body. In a preferred embodiment, apparatus for hanging articles and the hook portion are made from recycled or recyclable material.

27 Claims, 9 Drawing Sheets

U.S. PATENT DOCUMENTS

| | | | | |
|---|---|---|---|---|
| 5,868,289 | A | 2/1999 | Lee | |
| 5,957,344 | A | 9/1999 | Kolton | |
| 6,110,553 | A | 8/2000 | Grosskopf et al. | |
| 6,135,330 | A | 10/2000 | Wang | |
| 6,325,257 | B1 | 12/2001 | Micciche' et al. | |
| 6,588,633 | B1 | 7/2003 | Ammann | |
| 6,892,910 | B2 | 5/2005 | Capuano et al. | |
| 7,086,635 | B1 | 8/2006 | Drapeau | |
| D548,982 | S | 8/2007 | Chernicoff et al. | |
| 7,267,252 | B2 | 9/2007 | Goodman | |
| 2004/0031825 | A1 | 2/2004 | Roberts | |
| 2005/0274752 | A1 | 12/2005 | Goodman | |
| 2006/0065681 | A1 | 3/2006 | Yeh et al. | |
| 2007/0068981 | A1 | 3/2007 | Koeda et al. | |
| 2007/0199964 | A1* | 8/2007 | Gouldson | 223/91 |
| 2008/0017677 | A1* | 1/2008 | Hondroulis | 223/85 |

FOREIGN PATENT DOCUMENTS

| | | | |
|---|---|---|---|
| DE | 93 18 060.8 | | 4/1994 |
| DE | 44 24 694 | A1 | 1/1996 |
| EP | 0 651 960 | A1 | 11/1994 |
| FR | 2 758 070 | A1 | 6/1997 |
| GB | 1078507 | | 8/1967 |
| GB | 2 285 214 | A | 7/1995 |
| GB | 2 324 239 | A | 10/1998 |
| GB | 2 352 170 | A | 1/2001 |
| JP | 10075872 | A * | 3/1998 |
| JP | 10-295522 | | 11/1998 |
| JP | 11-164766 | | 6/1999 |
| JP | 2000-152 | | 1/2000 |
| JP | 2001061618 | | 3/2001 |
| SE | 519 026 | | 12/2002 |
| WO | WO 96/36263 | | 11/1996 |

OTHER PUBLICATIONS http://www.dittohangers.com; ditto, Welcome to the new home of Ditto Hangers, "Ditto 100% Recyclable Paper Hangers", p. 1 of 1—Oct. 2, 2007.

http://www.dittohangers.com; ditto, Welcome to the new home of Ditto Hangers, "Ditto 100% Recyclable PET Hangers", p. 1 of 1—Oct. 2, 2007.

The International Search Report and The Written Opinion of the International Searching Authority dated Jun. 26, 2008.

* cited by examiner

COMPOSITE HANGER

BACKGROUND OF THE INVENTION

1. Field of the Invention

The present invention relates generally to clothes hangers, and more particularly to environmentally friendly hanger constructions that include a paperboard body with a first and a second panel, at least one central tab extended from a peripheral edge of one of the panels, and a polymeric hook secured the paperboard body using the central tab.

2. Background of the Related Art

Numerous hangers have been developed as alternatives to conventional metal and plastic hangers. U.S. Pat. No. 5,868,289 discloses a folded paperboard hanger that includes a slant plate part 1 having two slant portions, and a connecting plate part 2 that is connected to the ends of the slant portions, so as to form an isosceles triangular structure. A hanging plate part 3 is integrally formed with the slant plate part for hanging the hanger and a reinforcement plate part 4 extends at a 90-degree angle from either the slant plate part 1 or the connecting plate part 2, so as to stiffen the hanger.

U.S. Pat. No. 5,027,945 discloses a merchandise support assembly that includes a paperboard blank 10 having first, second, third, fourth, and fifth portions 12, 14, 16, 18, and 26, respectively, folded at crease lines 20, 22, 24, and 28. The second portion 14 is folded at the crease line 20, so that it overlies part of the first portion 12 to which it is secured by adhesive. Folding at crease lines 20, 22 forms a pocket between the second and fourth portions 14, 18 that are spaced apart by the width of the third portion 16. A hook 40, which is made from a stiff flexible plastic material, includes a hook member 42 and flexible resilient support arms 46 inserted through an opening 38 adjacent a fourth crease line 28 at the junction of the first and fifth portions 12, 26. The arms 46 engage the sheet material along crease line 28 to support the folded blank 10.

U.S. Patent Application Publication No. 2004/0031825A1 discloses a garment hanger that includes two parts or elements 2, 2' that are hinged together so that they can be folded from a first relatively flat or opened out configuration to a second configuration in which the two parts or elements are adjacent and facing each other. At least one of the parts including first means 15, a hook, by which the hanger can depend from a support when in its second configuration. The two parts provide a second means 12, shoulders, from which a garment can be hung. The two parts or elements are preferably of a flexible stiff sheet material, such as a corrugated material, e.g. corrugated cardboard.

The hanger designs discussed above pose several disadvantages. Hangers that are manufactured entirely from paper do not provide enough support to become acceptable substitutes especially in retail markets. Once a weak spot is formed in the hook portion of an all paper hanger, structural failure quickly results no matter how reinforced the paper. Further, all paper construction cannot be used with standard dry cleaning equipment because the hangers will tear or shred.

Moreover, previous hanger designs that utilize separate non-paper hooks often have weak attachment mechanisms. For example, the cantilevered support arms of the hook in U.S. Pat. No. 5,027,945 are simply manipulated into place between the paperboard layers of the hanger. No adhesive is used to secure the support arms of the hook within the paperboard hanger body. Designs, which rely on the flexural strength of the hook support arms or use a paper hook cannot support heavy garments.

Billions of hangers are discarded each year. Only 15% of hangers are typically recycled with most going into landfills. Thus, there is a need for an environmentally friendly, easy-to-use, and structurally sound hanger that can be manufactured quickly and at an acceptably low cost.

SUMMARY OF THE INVENTION

One aspect of the present invention is directed to an apparatus for hanging articles, such as clothing, that includes, inter alia, a hanger body and a polymeric hook and methods for making the same. The hanger body has first and second paperboard panels separated from one another by a fold line. The first paperboard panel includes a central tab, which extends from a periphery thereof, opposite the lower edge thereof. The polymeric hook engages with the central tab of the hanger body and includes a support portion and a hook base. The hook base has an alignment aperture formed therein through which the central tab of the first paperboard panel is inserted so as to secure the polymeric hook to the hanger body.

Another aspect of the present invention is directed to an apparatus for hanging articles such as clothing that includes, inter alia, the hanger body that has first and second paperboard panels separated by a lower edge. The first paperboard panel includes a central tab, which extends from a periphery thereof. The polymeric hook portion engages with the hanger body and includes a support portion and a hook base. The hook base has an alignment aperture formed therein. The central tab of the first paperboard panel is inserted through the alignment aperture of the hook base to secure the polymeric hook to the hanger body. Preferably, the paperboard body of the hanger is manufactured from 100% recyclable material.

Another aspect of the invention is directed to a hook for an apparatus for hanging clothing that includes, inter alia, a base portion that defines an alignment aperture and a support portion extending from the base portion. Preferably, the base portion is substantially trapezoidal. Preferably, the hook is manufactured from 100% post consumer recycled product. Preferably, the hook is manufactured from a polymer. More preferably, the hook is manufactured from a thermoplastic polymer.

Another aspect of the invention is directed to an apparatus for hanging articles such as clothing that includes, inter alia, the hanger body having first and second paperboard panels separated from one another by a fold line. The first paperboard panel includes a central tab, which extends from a periphery thereof. The polymeric hook portion engages with the hanger body and includes a support portion and a hook base. The hook base has an alignment aperture formed therein. The central tab of the first paperboard panel is inserted through the alignment aperture of the hook base to secure the polymeric hook to the hanger body. A means for supporting items such as pants is engaged with the hanger body.

The invention further comprises a method of manufacturing an apparatus for hanging clothing that includes, inter alia, providing a hanger body that has first and second paperboard panels separated by a lower edge. At least one central tab extends from the periphery of the first paperboard panel. The second panel of the hanger body is positioned approximately 90-degrees with respect to the first panel. The central tab is folded with respect to the first paperboard panel. A hook for an apparatus for hanging clothing having a base portion that defines an alignment aperture and a support portion extending from the base portion is provided. The hook is dispensed onto the folded central tab by inserting the tab into the alignment aperture of the hook. Adhesive is applied on the inner surface of the central tab. The central tab is folded into engagement with the first paperboard panel so to secure the hook to the hanger body. Adhesive is applied to an interior surface of at least one of the paperboard panels of the hanger body. The first panel is folded over and onto the second panel to capture the hook and central tab. Preferably, the adhesive applied to the hanger is a hot melt adhesive or a cold melt adhesive.

The invention further comprises an apparatus for hanging articles such as clothing that includes, inter alia, the hanger body having first and second panels separated from one another by a fold line. The first panel includes a central tab, which extends from a periphery thereof. The hook portion engages with the hanger body and includes a support portion and a hook base. The hook base has an alignment aperture formed therein. The central tab of the first panel is inserted through the alignment aperture of the hook base to secure the hook to the hanger body.

BRIEF DESCRIPTION OF THE DRAWINGS

So that those having ordinary skill in the art to which the disclosed device and methods appertain will more readily understand how to make and use the same, reference may be had to the drawings wherein.

These and other features of the subject invention will become more readily apparent to those having ordinary skill in the art from the following detailed description of preferred embodiments.

DETAILED DESCRIPTION OF THE PREFERRED EMBODIMENTS

Reference is now made to the accompanying figures for the purpose of describing, in detail, exemplary embodiments of the present disclosure. The figures and detailed description are provided to describe and illustrate examples in which the disclosed subject matter may be made and used, and are not intended to limit the scope thereof.

Figure 1:
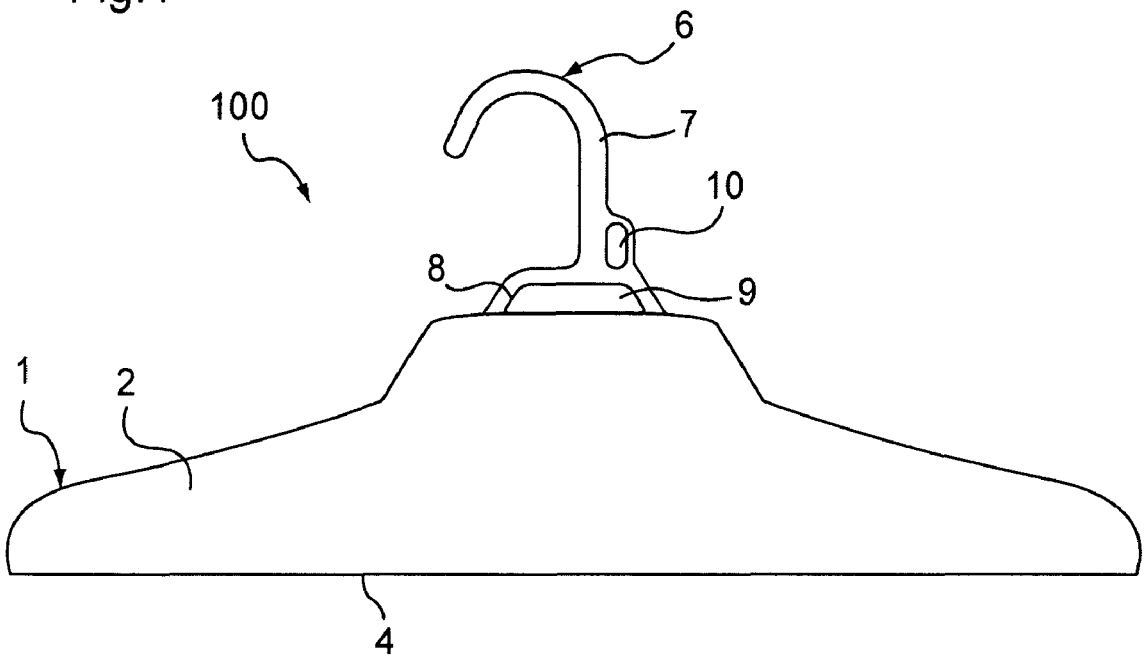
FIG. 1 is a front elevational view of an assembled hanger that has been constructed in accordance with an embodiment of the present invention.
Figure 2:
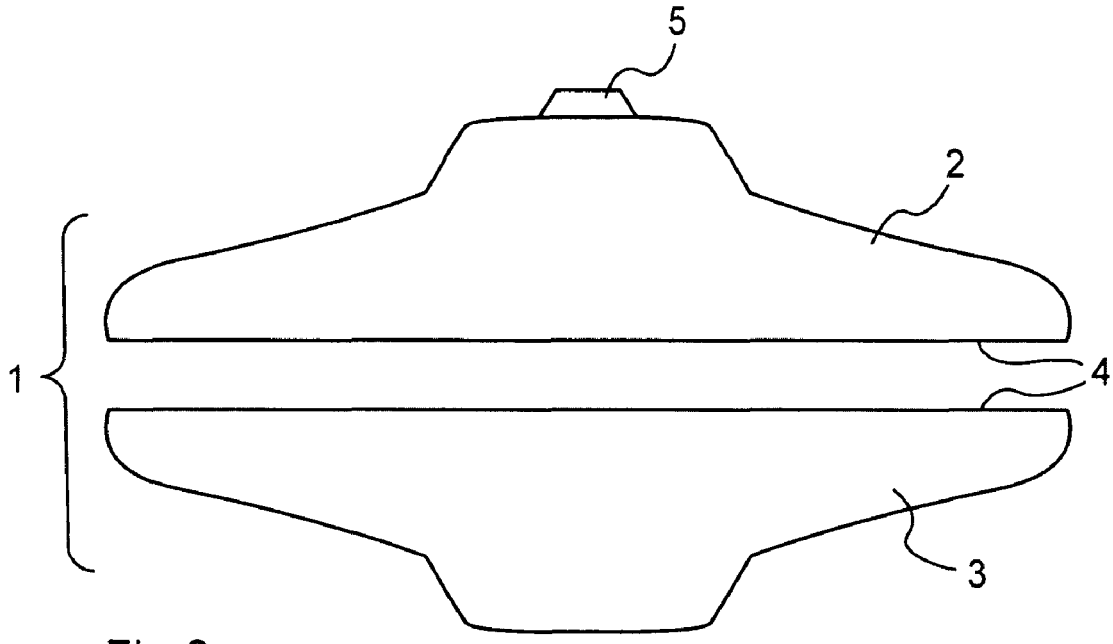
FIG. 2 is a front elevational view of an embodiment of the unassembled hanger wherein the hanger body has first and second paperboard panels, the first paperboard panel including a tab extending from a periphery thereof opposite the lower edge.

Referring now to the accompanying figures, there is illustrated in FIGS. 1 and 2, a garment hanger that has been constructed in accordance with a preferred embodiment of the present invention and identified as reference numeral 100. Garment hanger 100 includes hanger body 1 having first and second paperboard panels 2 and 3, which are separated by lower edge 4. In the embodiment shown in FIG. 1, the first and second panels 2 and 3 respectively, are separated along the bottom edge by a fold line. The first paperboard panel 2 includes a central tab 5 extending from a periphery thereof opposite the lower edge 4. In the embodiment illustrated in FIG. 2, the first and second panels 2 and 3 respectively, are not separated along the edge by a fold line but can be perforated or cut, or joined using a structure.

Figure 3:
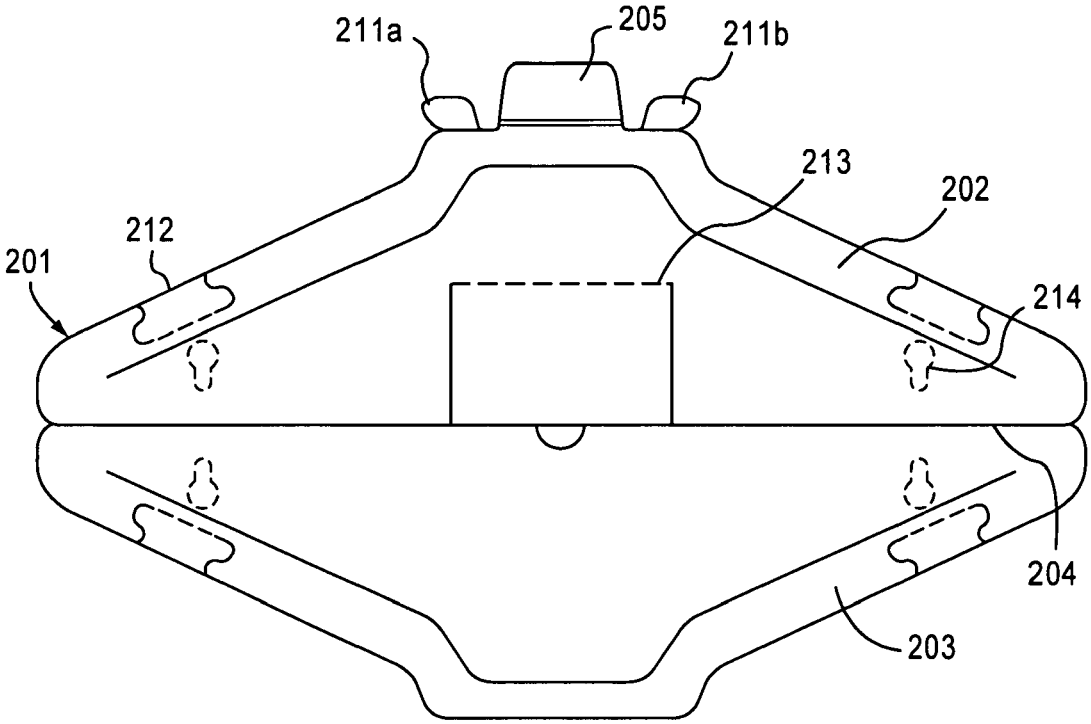
FIG. 3 is a front elevational view of an alternative embodiment of the unassembled hanger wherein the hanger body has first and second paperboard panels that are separated along the lower edge by a fold line, the first paperboard panel including a central tab extending from a periphery thereof opposite the lower edge and leaf tabs extending from opposing sides of the central tab, perforated portions for creating slots for securing garment straps, and a perforated portion for creating a detachable card.

In FIG. 3, a garment hanger body is illustrated that has been constructed in accordance with an alternative embodiment of the present invention and identified as reference numeral 201. Garment hanger body 201 includes first and second paperboard panels 202 and 203, which are separated by a lower edge 204. The first paperboard panel 202 includes a central tab 205 extending from a periphery thereof opposite the lower edge 204. The first paperboard panel 202 also includes at least two leaf tabs 211*a*, 211*b* extending on either side of the central tab 205. The first and second paperboard panels 202 and 203 respectively, include optional perforation areas which are removed to create slots for securing garment straps 212, or slots for securing a polymeric hanging bar 214. Additionally, the first paperboard panel 202 includes an optional perforation for a detachable card 213.

Hanger body 1 is manufactured from 100% recyclable material. Hanger body 1 is manufactured from paperboard having a thickness between about 30 to about 38 point paperboard. Those skilled in the art will appreciate that materials other than paperboard may be used to manufacture the hanger body 1. Materials that provide similar strength as paperboard may be used, for example, corrugated paperboard, linerboard, corrugated e-flute, and other biodegradable substrates such as polylactic acid.

It should be noted that the shape of the hanger body 1 may be modified, as desired, without departing from the spirit of the invention. For example, it may be desirable to change the shape of the hanger body 1 to accommodate hanging a particular item. Further, it may be desirable to include additional perforated regions to accommodate accessories, straps, or other such alterations.

Figure 4:
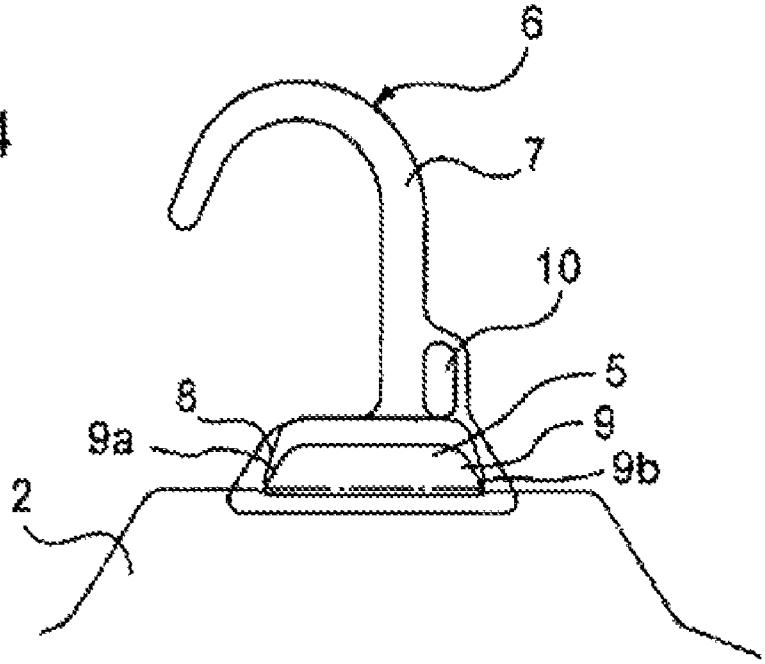
FIG. 4 is a front elevational view of a polymeric hook that has been constructed in accordance with an embodiment of the present invention and includes a substantially trapezoidal base portion and a support portion extending from the base portion.

As shown in FIG. 4, a polymeric hook 6 is dispensed onto the central tab 5 of the hanger body 1. The polymeric hook 6 includes a support portion 7 and a substantially trapezoidal base portion 8. The base portion 8 of the polymeric hook 6 has an alignment aperture 9 formed therein. In the presently disclosed embodiment, the polymeric hook 6 includes a mechanism for tying a plurality of polymeric hooks together that includes a slotted hole 10 adapted and configured for receiving a tying material. The slotted hole 10 is formed in a raised side portion of the polymeric hook 6.

The width of alignment aperture 9 is slightly larger than the width of the central tab 5 base. The alignment aperture 9 of the polymeric hook 6 has internal curves 9*a* and 9*b* that adapted and configured to engage with the periphery of the central tab 5 to create a self-locating mechanism when the central tab 5 is folded over. The self-locating mechanism serves to center the polymeric hook 6 on the central tab 5 of the hanger body 1.

Figure 5:
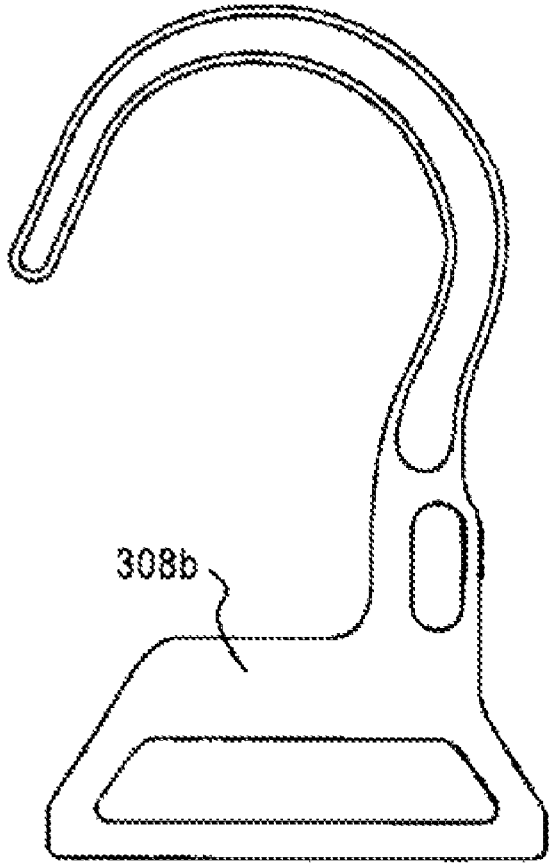
FIG. 5 is a front elevational view of a polymeric-hook that has been constructed in accordance with an embodiment of the present invention and includes branding indicia.

Careful consideration was given to the height, width, and thickness of the polymeric hook 6 so that it is manufactured to specifically fit within equipment found in dry cleaning businesses. The polymeric hook 6 is approximately between about 4 inches and about 4.5 inches in height and approximately between about 2.5 and about 3.75 inches wide. The support portion 7 itself is approximately between about 0.3 to about 0.45 inches wide and may or may not narrow toward the tip of the polymeric hook 6. Preferably, the polymeric hook 6 is manufactured so that the thickness permits at least 6 polymeric hooks to fit within a slot of a commercial dry cleaning belt. More preferably, the polymeric hook 6 is between 0.075 to about 0.090 inches thick. The polymeric hook 6 may be dimensioned or configured to allow for marking, advertisement, and/or branding area 308*b* as shown in FIG. 5. Preferably, such indicia remain visible after the hanger is assembled and a garment has been hung.

The polymeric hook 6 is manufactured from 100% post consumer recycled product. Polymeric hook 6 is manufactured from a thermoplastic polymer. In certain embodiments, the polymeric hook 6 can be manufactured from material selected from the group consisting of low-density polyethylene, high-density polyethylene, and polypropylene. Those skilled in the art will appreciate that materials other than that of the present embodiment may be used to manufacture the polymeric hook 6 such as biologically based polymers made from items such as corn or sugar, and synthetically grown fabrics.

Figure 6A:
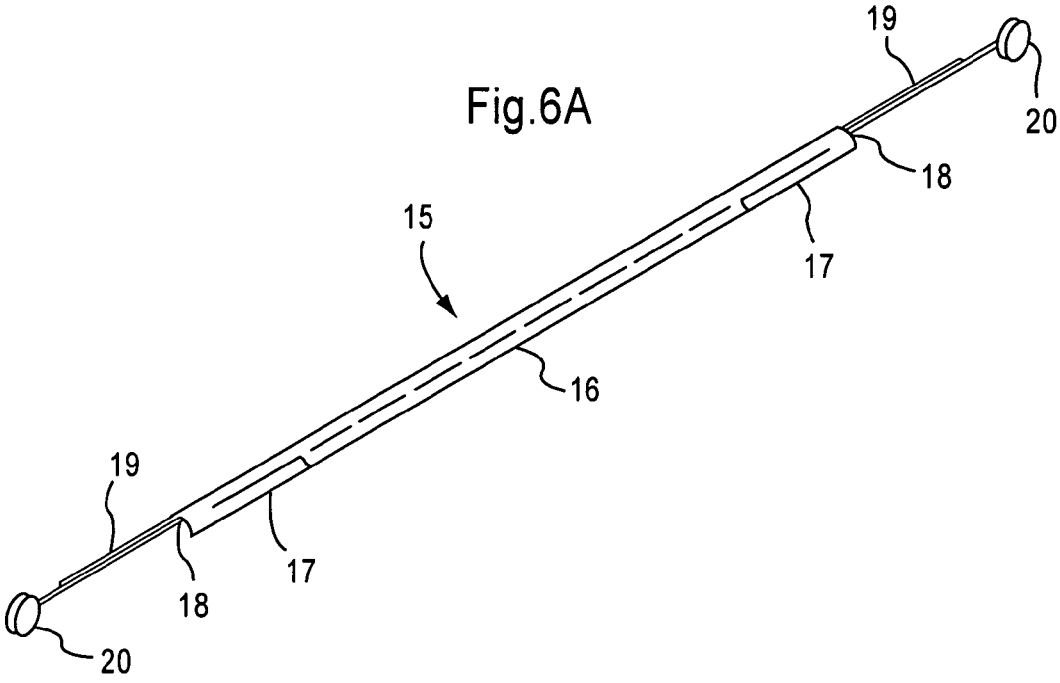
FIGS. 6A and 6B are perspective views of a polymeric support bar for pants and other items which is configured to attach to the hanger body using securing arms extending from each end.
Figure 6B:
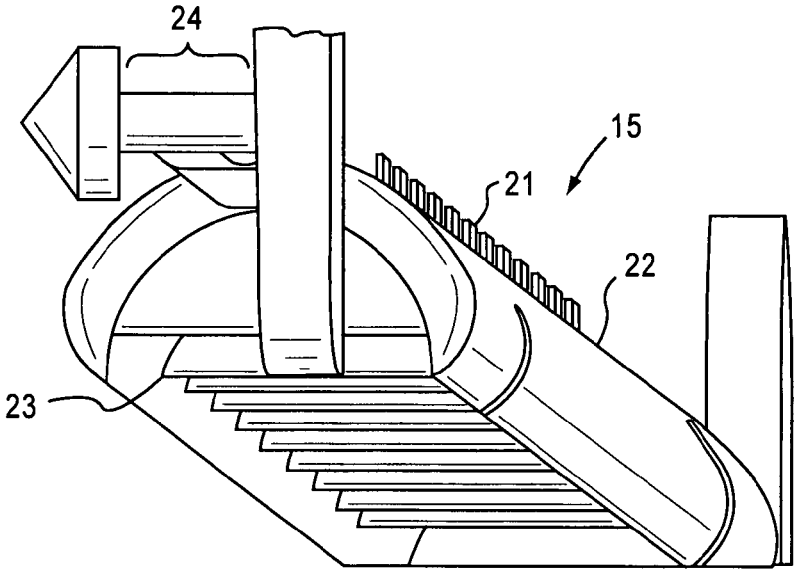
Figure 7:
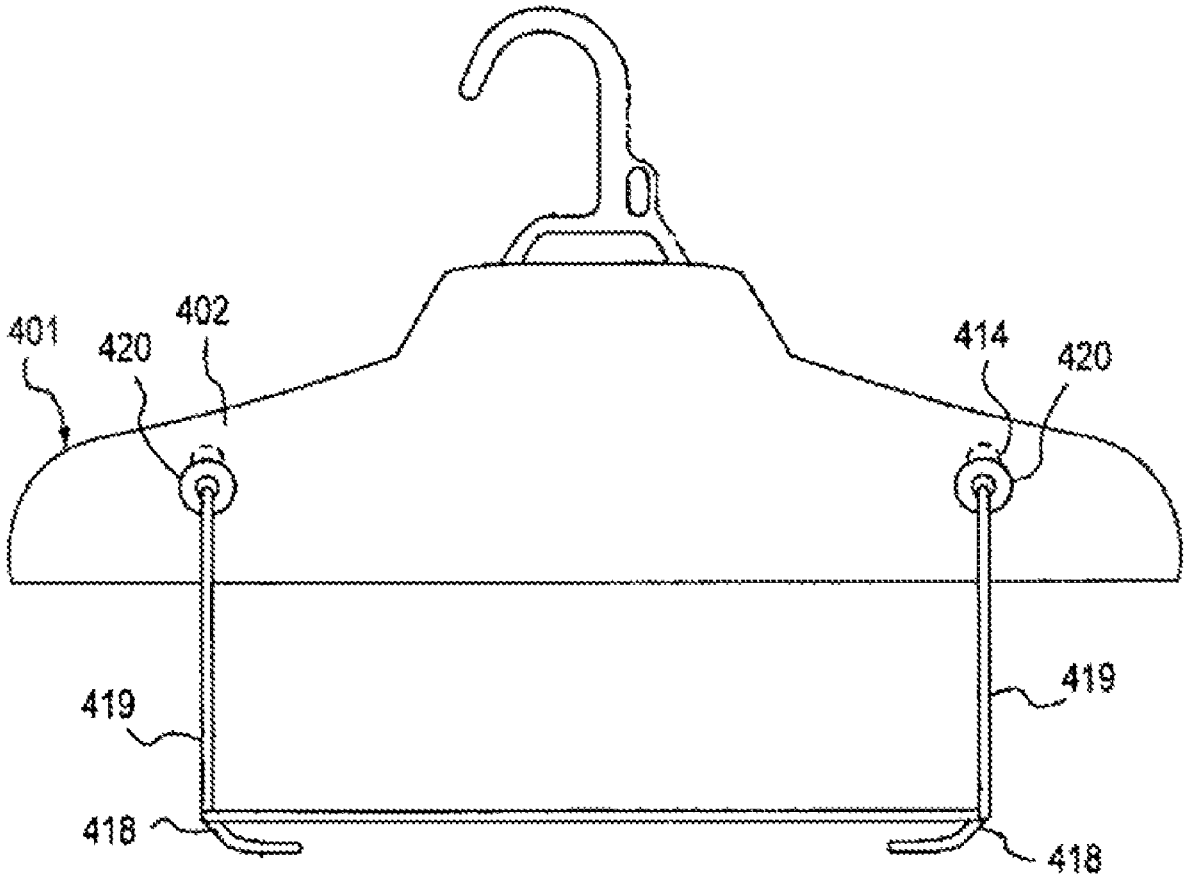
FIG. 7 is a front elevational view of an assembled hanger that has been constructed in accordance with an embodiment of the present invention wherein the hanger body has a polymeric hanging bar attached thereto having a support bar and securing arms extending from each end and connected to the support bar through a living hinge, each securing arm including an attachment mechanism at its tip.

In FIG. 6A, an embodiment for the means for supporting pants is illustrated as pants hanger 15. The pants hanger 15 is illustrated having a support bar 16 and securing arms 19 extending from each end and connected to the support bar 16 through a living hinge 18. Each of the securing arms 19 has an attachment means 20 formed at its tip. FIG. 6A also shows the bendable clips 17 attached at either end of the support bar 16 prior to the living hinge 18 with the securing arms 19. The bendable clips 17 may be bent away from the support bar 16 to secure garments or other items to the support bar 16. As shown in FIG. 6B, the attachment means 20 can be pointed to punch through slotted holes in the first and second paperboard panels 2 and 3. The distance 24 between the point and the plate of the attachment means 20 is sized to be approximately similar thickness as the hanger body 1. FIG. 6B also shows the pants hanger 15 can have a curved support surface 22 and optionally have raised "fingers" 21 or hairs at any area along the bar to create friction to keep items, such as pants, from slipping from the pants hanger 15. The pants hanger 15 can also have stiffeners 23 to add the tension to the pants hanger 15. As shown in FIG. 7, the securing arms 419 are bent upward at the living hinge 418 and the attachment means 420 are engaged with the first paperboard panel 402 and second paperboard panel (not shown) of the hanger body 401 at the optional perforated slots 414 (also shown in FIG. 3).

Pants hanger 15 and the items attached thereto including the support bar 16, securing arms 19, attachment means 20, and bendable clips 17 are manufactured from a thermoplastic polymer. In a preferred embodiment, pants hanger 15 and the items attached thereto are made from recycled or recyclable material. In certain embodiments, the polymeric hanging bar 15 and its related items can be manufactured from material selected from the group consisting of low-density polyethylene, high-density polyethylene, and polypropylene. Those skilled in the art will appreciate that materials other than that of the present embodiment may be used to manufacture the pants hanger 15 such as biologically based fabrics made from items such as corn or sugar, and synthetically grown fabrics. Further, pants hanger 15 may be perforated (as shown) or hollowed by other means to make it light weight.

Those skilled in the art will appreciate that the fingers on the pants hanger 15 can be manufactured from any materials that will create friction between the items to be hung on the pants hanger 15 and the fingers. These materials include the materials used to manufacture the polymeric hook 6 and/or materials other than that of the present embodiments may be used to manufacture the such as biologically based fabrics made from items such as corn or sugar, and synthetically grown fabrics.

Figure 8:
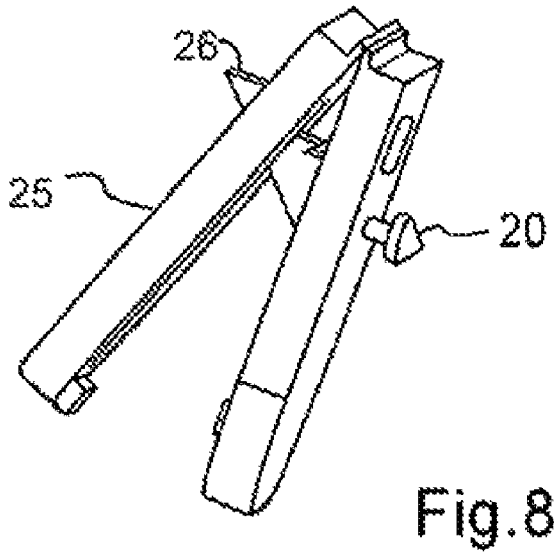
FIG. 8 is a perspective view of an alternative embodiment of a mechanism for supporting pants on the hanger.

FIG. 8 illustrates one alternative embodiment for the punch means 20. FIG. 8 shows a clip 25 attached to the back of the attachment means 20 for clipping articles of clothing or items to the pants hanger 15. The clip 25 includes a clip ratchet 26.

Figure 9:
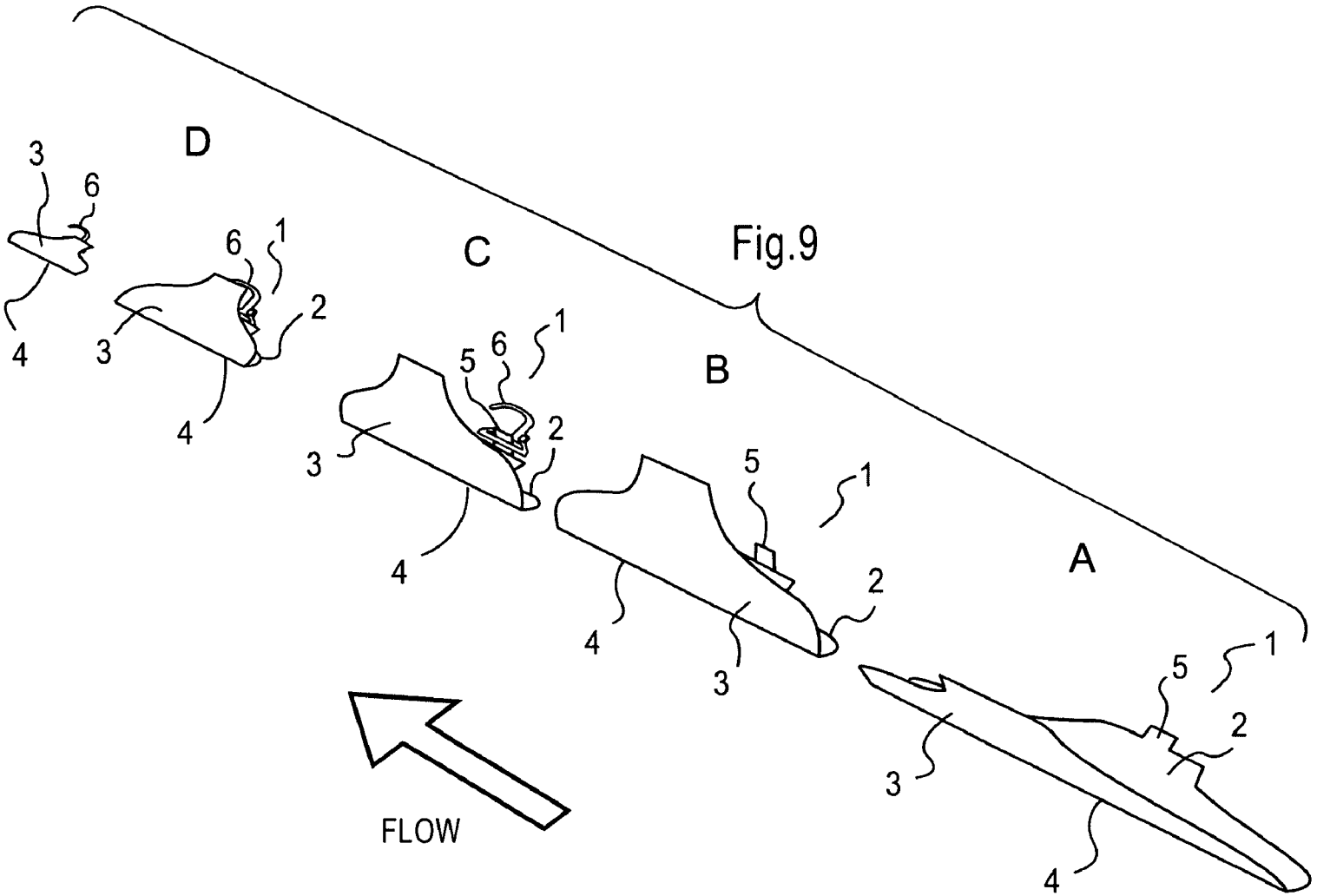
FIG. 9 is a perspective view of the method for making a hanger according to the present invention.

Referring now to FIG. 9, there is illustrated a portion of the method for manufacturing an apparatus for hanging clothing including in position A, the step of providing a hanger body 1 having first and second paperboard panels 2 and 3 that are separated from one another by a lower edge 4. The first paperboard panel 2 includes at least a central tab 5 extending from a periphery thereof opposite the lower edge 4. The second paperboard panel 3 is positioned approximately 90 degrees with respect to the first paperboard panel 2. This action may be taken to square the hanger body 1 blank with a hook applicator. The position labeled B illustrates the central tab 5 of the hanger body 1 is folded with respect to the first paperboard panel 2.

The position labeled C illustrates a polymeric hook 6 for hanging clothing that is provided comprising a base portion 8 that defines an alignment aperture 9 and a support portion 7 extending from the base portion 8. The polymeric hook 6 is dispensed onto the folded central tab 5. The polymeric hook 6 is located and locked with the folded central tab 5. Adhesive is applied on an inner surface of the central tab 5. The central tab 5 is folded into engagement with the first paperboard panel 2 so as to secure the polymeric hook 6 to the hanger body 1. Adhesive is applied to an interior surface of at least one of the first or second paperboard panels 2 and/or 3 of the hanger body 1. The position labeled D illustrates that the second paperboard panels 3 is placed over onto the first paperboard panel 2 to capture the hook 6 and central tab 5. An alternative embodiment further includes compressing the assembled polymeric hook 6 and hanger body 1. It is understood that although the positions are depicted in an order in FIG. 9, these positions may be conducted in a variety of orders to achieve the desired embodiments of the present invention. It is also understood that the alternative embodiments may include additional leaf tabs 211*a* and 211*b*, as shown in FIG. 3. The leaf tabs 211*a* and 211*b* are folded and treated with adhesive similarly to the central tab 5.

Preferably the adhesive applied to the garment hanger is a hot melt adhesive or a cold melt adhesive.

Figure 10:
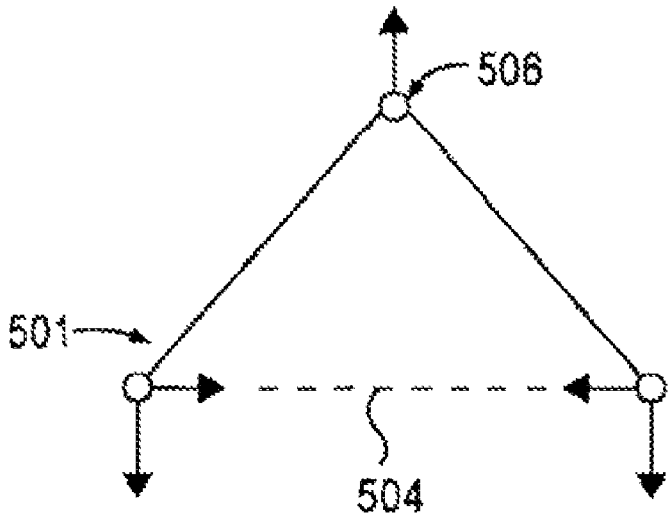
FIG. 10 is diagram of the force distribution within the assembled hanger.

The fold line at the bottom edge of the first and second panels 2 and 3 functions like and I-beam and increases the rigidity of the garment hanger 100. FIG. 10 shows the polymeric hook 506 in combination with the assembled garment hanger body 501, and the lower edge 504 being a fold line produce a truss effect wherein when a garment or item is hung on the assembled hanger body 501, and the hanger is hung by the polymeric hook 506, the load generates tension or compression that is shared by the lower edge 504 fold line, the assembled hanger body 501, and the polymeric hook 506 in combination. This combination is much more efficient and structurally sound than without the fold line. However, the other embodiments of the garment hanger are capable of functioning efficiently when the first and second paperboard panels 2 and 3 are separated by a lower edge 4 that is not a fold line.

The polymeric hook 6 and its self-locating and locking mechanism with the central tab 5 provide greater strength than previous hanger embodiments. The leaf tabs 211*a* and 211*b* provide even greater strength to the garment hanger by providing more surface area for adhesive to be applied.

The leaf tabs 211*a* and 211*b* also allow the polymeric hook 6 to be applied and aligned at ultra high speeds thereby allowing a higher rate of processing garment hangers. The garment hangers of the present invention can be produced at speeds of 21,000 to 22,000 hangers per hour. Previous hanger embodiments constructed entirely of paper were capable of producing only 8000 hangers per hour. The present invention provides a clear advantage over previous embodiments by permitting a higher output of garment hangers made of recycled and recyclable materials at a lower cost. Speed of manufacture is critical because hangers are a low cost item.

Figure 11:
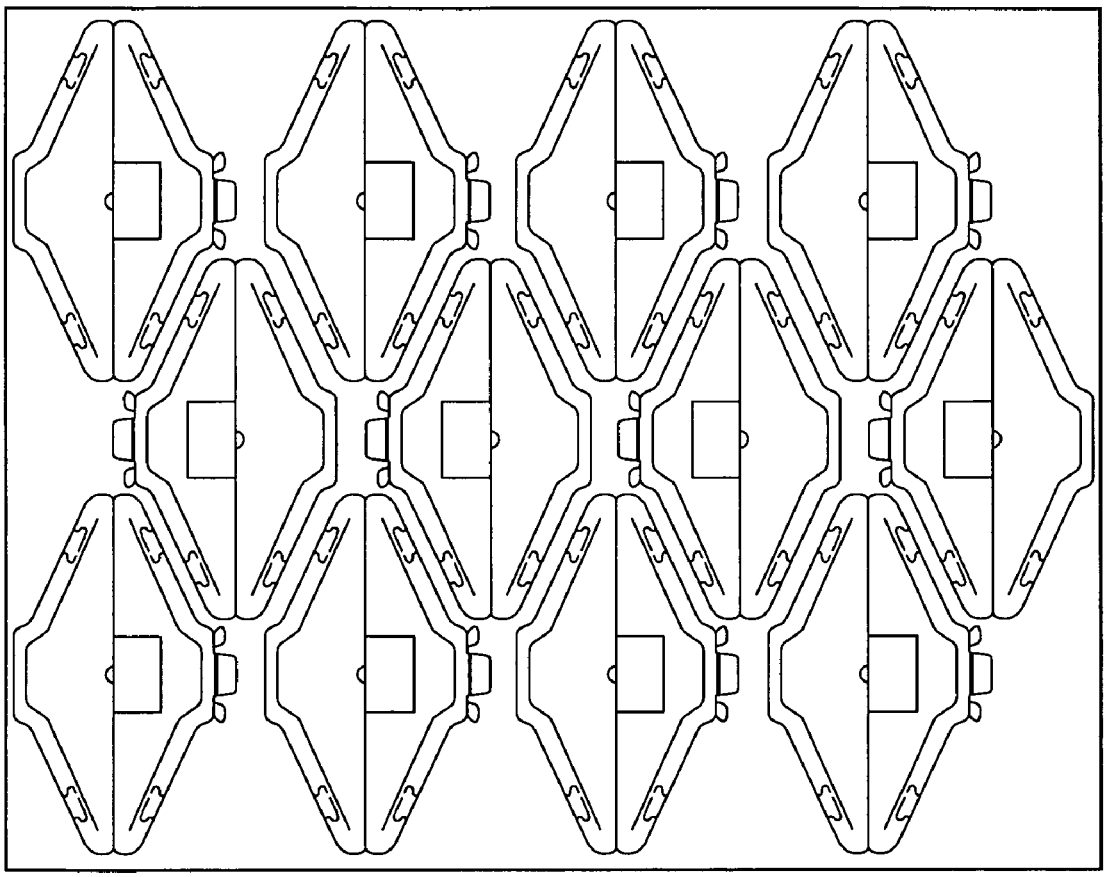
FIG. 11 is a plan view of a substrate blank in which a plurality of hanger bodies is nested.

The hanger bodies 1 are designed in such a way as to allow for maximum nesting on a single piece of paperboard or other desired material as shown in FIG. 11. Having the fold line posted at the bottom of the hanger body 1 helps to permit this nesting and increase the number of hanger bodies that can be formed from a single piece of paperboard. Preferably, the fold line is aligned along the grain of the paperboard. Although an angled alignment of the fold line, such as a 45 degree offset in alignment of the fold line on the paperboard sheet is more space efficient the arrangement creates an unusable hanger. Offsetting the fold line by various degrees causes the folded structures to "propeller" creating unusable hangers. The present invention is advantageous over other designs because it maximizes the number of hanger bodies that can be created or nested on a sheet. Also, fold lines perpendicular to the grain create hangers undesirable hangers that have no resistance to the vertical failure along the grain direction causing them to fold over.

Hanger embodiments that have fold lines at the top of the hanger body cannot nest as many hanger bodies onto a single sheet of paperboard material. Moreover, without the increased area of a hook, more hanger bodies 1 can be nested on a single piece of paperboard than hangers that are manufactured entirely from paper. Due to the combination of the paperboard hanger body 1 and the polymeric hook 6, the present invention is manufactured in a way that increases speed by 300 percent over all paper hanger alternatives with equivalent hook strength (4-ply hook) and reduces costs by at least 45 percent. The claimed invention removes the tedious and slow folding process required by previous hanger embodiments constructed entirely of paper and reduces the amount of paper used.

Further, the present invention uses an extrusion process to produce the polymeric hook at widths acceptable to fit in and durable enough to be used with at least 99 percent of standard dry cleaning machinery. This is another clear advantage over previous embodiments of previous alternative hanger designs, especially all paper hook constructions that would be easily shredded on standard dry cleaning machinery.

The following example provides strength comparisons between the claimed invention and conventional hanger constructions.

EXAMPLE

Three-ply, 4-ply, 13-gauge white coated wire, polypropylene (PP) plastic, and high density polyethylene (HDPE) hangers were strength tested using a vertical pull test. The hook or hanger was placed in a gripper vice from below and the hook was connected to a "S" hook for the vertical pull. The hook was pulled to the point of failure at a rate of 10 inches per minute and the maximum readings were recorded for the various hangers. The paper hooks were tested in two conditions: prebroken (with a weak spot) and pristine. The results are recorded in Table 1.

TABLE 1

Vertical Pull Results for Various Hanger Types

| Hook Type | All-Paper Hanger (3-Ply) Non-Broken | All-Paper Hanger (3-Ply) Broken (flexed) | All-Paper Hanger (4-Ply) Non-Broken | All-Paper Hanger (4-Ply) Broken (flexed) | Wire Hanger (13 ga.) .075" | Plastic Hook 0.075" PP | Plastic Hook 0.080 PP | Plastic Hook 0.090" HDPE | Plastic Hook 0.090" PP |
|---|---|---|---|---|---|---|---|---|---|
| | 9.1 | 4.8 | 10.12 | 8.75 | 6 | 4.75 | 5.5 | 6 | 8.2 |
| | 7 | 7.8 | | | 6.375 | 4.75 | 5.75 | 6.25 | 9 |
| | 7.5 | | | | 6.25 | 4.5 | 5.5 | 6.125 | 10.15 |
| | 7.1 | | | | 5.95 | | | 6.5 | 10.375 |
| | | | | | 5.125 | | | 7.125 | 10.8 |
| | | | | | 6.25 | | | 7.5 | 11.75 |
| | | | | | 6.1 | | | 6.875 | 10.125 |
| | | | | | 6.3 | | | 6.875 | |
| | | | | | 5.8 | | | 6 | |
| Avg | 7.675 | 6.3 | 10.12 | 8.75 | 6.016667 | 4.67 | 5.58 | 6.583333 | 10.05714 |
| | 17.92% drop | | 13.54% drop | | | | | | |

As shown in Table 1, the 0.090 inch thick polypropylene hook of the claimed invention produced the best overall results to the vertical strength test. Although the 4-ply paper hook and the 0.090 inch thick polypropylene hook of the claimed invention resulted in averages very close to one another, several of the 0.090 inch thick polypropylene hook trials resulted in values higher than the average for the 4-ply paper hook. Also, once the 4-ply paper hook incurred damage or was "broken" the vertical test results dramatically fall below the averages of the hook of the claimed invention. The 0.090 inch thick polypropylene hook of the current invention provides greater strength than previous hanger embodiments.

It should be noted that while the applicability of the garment hanger for the dry cleaning industry was discussed at length, the garment hanger of the claimed invention may be adapted for the needs of hanging or displaying in related industries including, inter alia, clothing, accessory, and shoe retail, hospitality, government, military and uniform operations. The claimed invention may also be adapted for in home use.

While the foregoing description includes details, which will enable those skilled in the art to practice the invention, it should be recognized that the description is illustrative in nature and that many modifications and variations thereof will be apparent to those skilled in the art having the benefit of these teachings. It is accordingly intended that the invention herein be defined solely by the claims appended hereto and that the claims be interpreted as broadly as permitted by the prior art.

What is claimed is:

1. An apparatus for hanging articles comprising:

a hanger body having first and second paperboard panels having substantially similar shapes, separated from one another by a fold line, wherein when the hanger body is in a folded orientation along the fold line, the first paperboard panel is in a facing relationship with the second paperboard panel;

the first paperboard panel including a central tab extending from a periphery thereof opposite the fold line thereof and two alignment tabs that are formed on opposite sides of the central tab; and an extruded polymeric hook portion including a support portion and a hook base, the hook base having a closed alignment aperture formed therein, wherein the polymeric hook portion has a thickness of between about 0.075 inches to about 0.090 inches;

wherein when the central tab of the first paperboard panel is inserted into the alignment aperture, the polymeric hook is engaged with the hanger body, the central tab and two alignment tabs are folded along the same line and sandwiched between the first paperboard panel and the second paperboard panel, and the polymeric hook portion is stably maintained in the same position with respect to the hanger body; and wherein the apparatus is specifically designed for use by dry cleaning establishments.

2. The apparatus of claim 1, wherein the alignment aperture defined by the hook base is adapted and configured for centering the polymeric hook on the central tab of the hanger body.

3. The apparatus of claim 1, wherein the hanger body is made from 100% recyclable material.

4. The apparatus of claim 1, wherein the hanger body is made from between about 30-point to about 38-point paperboard.

5. The apparatus of claim 1, wherein the polymeric hook is manufactured from 100% post consumer-recycled product.

6. The apparatus of claim 1, wherein the polymeric hook is manufactured from a thermoplastic polymer.

7. The apparatus of claim 6, wherein the polymeric hook is manufactured from a material selected from the group consisting of low-density polyethylene, high-density polyethylene, and polypropylene.

8. An apparatus for hanging articles comprising:

a hanger body having first and second paperboard panels having substantially similar shapes, separated from one another by a lower edge;

the first paperboard panel including a central tab extending from a periphery thereof opposite the lower edge thereof and two alignment tabs that are formed on opposite sides of the central tab; and an extruded polymeric hook portion including a support portion and a hook base, the hook base having a closed alignment aperture formed therein, wherein the polymeric hook has a thickness of between about 0.075 inches to about 0.090 inches;

wherein when the central tab of the first paperboard panel is inserted into the alignment aperture and adhered to the second paperboard panel, the polymeric hook is engaged with the hanger body, the central tab and two alignment tabs are folded along the same line and sandwiched between the first paperboard panel and the second paperboard panel, and the polymeric hook portion is stably maintained in the same position with respect to the hanger body, and the first paperboard panel is in a facing relationship with the second paperboard panel;

wherein the apparatus is specifically designed for use by dry cleaning establishments.

9. The apparatus of claim 8, wherein the hanger body is made from 100% recyclable material.

10. The apparatus of claim 8, wherein the hanger body is made from between about 30-point to about 38-point paperboard or other board product equivalent or similar thereto.

11. The apparatus of claim 8, wherein the polymeric hook is manufactured from 100% post consumer-recycled product.

12. The apparatus of claim 8, wherein the polymeric hook is manufactured from a thermoplastic polymer.

13. The apparatus of claim 12, wherein the polymeric hooks is manufactured from material selected from the group consisting of low-density polyethylene, high-density polyethylene, and polypropylene.

14. An apparatus for hanging articles comprising:

a hanger body having first and second paperboard panels having substantially similar shapes, separated from one another by a fold line, wherein when the hanger body is in a folded orientation the first paperboard panel is in a facing relationship with the second paperboard panel;

the first paperboard panel including a central tab extending from a periphery thereof opposite the fold line thereof and two alignment tabs that are formed on opposite sides of the central tab;

an extruded polymeric hook portion including a support portion and a hook base, the hook base having a closed alignment aperture formed therein, wherein the polymeric hook portion has a thickness of between about 0.075 inches to about 0.090 inches;

wherein when the central tab of the first paperboard panel is inserted into the alignment aperture the polymeric hook is engaged with the hanger body, the central tab and two alignment tabs are folded along the same line and sandwiched between the first paperboard panel and the second paperboard panel, and the polymeric hook portion is stably maintained in the same position with respect to the hanger body; and means for supporting articles engaged with the hanger body;

wherein the apparatus is specifically designed for use by dry cleaning establishments.

15. The apparatus of claim 14, wherein the means for supporting articles includes a pants hanger that includes a support bar with securing arms extending from each end and connected to the support bar through a living hinge, each securing arm having an attachment means associated therewith for securing the pants hanger to the hanger body, wherein the attachment means are engaged with the first and second paperboard panels of the hanger body at perforated slots in the first and second paperboard panels of the hanger body.

16. The apparatus of claim 15, wherein the support bar further comprises at least one bendable clip formed at each end.

17. The apparatus of claim 15, wherein the support bar further comprises gripping fingers or hairs.

18. The apparatus of claim 15, wherein the gripping fingers or hairs are manufactured from a thermoplastic polymer.

19. The apparatus of claim 15, wherein means for supporting pants includes securing clips for clipping pants or items to the hanger body.

20. The apparatus of claim 15, wherein the support bar is perforated.

21. The apparatus of claim 15, wherein the alignment aperture defined by the hook base is adapted and configured for centering the polymeric hook on the central tab of the hanger body.

22. The apparatus of claim 15, wherein the hanger body is made from 100% recyclable material.

23. The apparatus of claim 15, wherein the hanger body is made from between about 30-point to about 38-point paperboard.

24. The apparatus of claim 15, wherein the polymeric hook is manufactured from 100% post consumer-recycled product.

25. The apparatus of claim 15, wherein the polymeric hook is manufactured from a thermoplastic polymer.

26. The apparatus of claim 25, wherein the polymeric hook is manufactured from material selected from the group consisting of low-density polyethylene, high-density polyethylene, and polypropylene.

27. An apparatus for hanging articles comprising:

a hanger body having first and second panels having substantially similar shapes, separated from one another by a fold line, the hanger body comprising perforation for a detachable card, wherein when the hanger body is in a folded orientation along the fold line the first panel is in a facing relationship with the second panel;

the first panel including a central tab extending from a periphery thereof opposite the fold line thereof and two alignment tabs that are formed on opposite sides of the central tab; and an extruded polymeric hook portion including a support portion and a hook base, the hook base having a closed alignment aperture formed therein, wherein the polymeric hook portion has a thickness of between about 0.075 inches to about 0.090 inches;

wherein when the central tab of the first panel is inserted into the alignment aperture the polymeric hook is engaged with the hanger body, the central tab and two alignment tabs are folded along the same line and sandwiched between the first panel and the second panel, and the polymeric hook portion is stably maintained in the same position with respect to the hanger body.

* * * * *